United States Patent [19]

Senn

[11] 3,990,249

[45] Nov. 9, 1976

[54] METHOD AND AN APPARATUS FOR PRODUCING A DRAINING CHANNEL

[76] Inventor: Georg Senn, Hubackerstrasse 4, 8967 Widen, Switzerland

[22] Filed: July 21, 1975

[21] Appl. No.: 597,918

[30] Foreign Application Priority Data

July 30, 1974 Switzerland ..... 10444/74

[52] U.S. Cl. ..... 61/10; 61/36 A; 61/45 R

[51] Int. Cl.[2] ..... E02B 11/00

[58] Field of Search ..... 61/1 R, 10, 11, 36 A, 61/45 R; 52/127

[56] References Cited

UNITED STATES PATENTS

| | | | |
|---|---|---|---|
| 331,656 | 12/1885 | Sooysmith | 61/36 A |
| 2,291,680 | 8/1942 | Billner | 52/127 X |
| 3,381,479 | 5/1968 | Curzio | 61/45 R |

*Primary Examiner*—Paul R. Gilliam
*Assistant Examiner*—David H. Corbin
*Attorney, Agent, or Firm*—Michael J. Striker

[57] ABSTRACT

A strip of snow is applied to a support surface which is to be drained, and covered with a quick-setting concrete. When the snow melts after setting of the quick-setting concrete, the space between the support structure and the set concrete which was previously taken by the snow serves as a draining channel. The apparatus for producing the channel includes a snow-making machine, a spray nozzle for the snow, and a spray nozzle for the quick-setting concrete.

14 Claims, 4 Drawing Figures

FIG.2
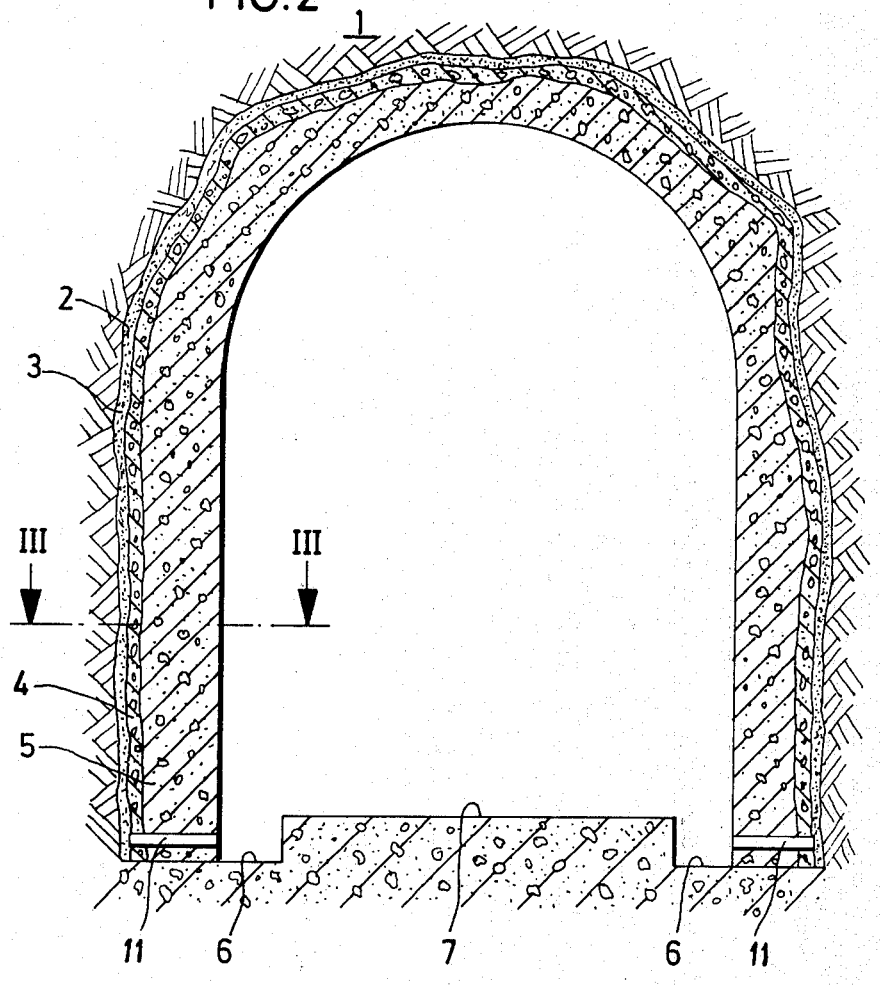
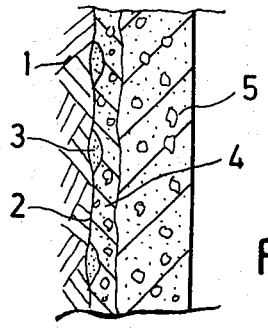
FIG.3

METHOD AND AN APPARATUS FOR PRODUCING A DRAINING CHANNEL

BACKGROUND OF THE INVENTION

The present invention relates to a method for producing a draining channel at a support structure, and to an apparatus for producing such a draining channel. More particularly, the present invention relates to a method and apparatus for draining tunnels or similar underground excavations.

There are many instances in which, for instance, water is to be drained from underneath or behind a fluidimpermeable layer, such as a concrete wall or the like. In such situations, it is usually necessary to provide a plurality of draining channels behind or underneath the layer, which draining channels collect the water and conduct the same to a spaced location at which it is discharged. The reason for providing the draining channels is to prevent build-up of pressure underneath or behind the layer, which would otherwise result in damage to the layer. In the following discussion, the present invention will be explained as utilized in underground excavations, such as tunnels, in which the above-mentioned layer is a concrete wall structure lining the natural walls of the excavation. However, this is not the only application to which the method and apparatus of the present invention can be put, as will be readily appreciated.

During the construction of tunnels or other underground spaces, it is a very frequent occurrence that water seeps from the natural rock or soil surrounding the underground space or tunnel into the latter, and such water must, of course, be conducted or pumped away from such an underground space. When the rock surrounding the underground space is kept in its natural state, except for the provision of spaced supports, the water seepage usually does not create any problems; however, the situation is different when the rock is to be provided with a concrete lining which gives the tunnel or underground space its final shape. Under these circumstances, the water which enters the space to be lined to form droplets or even springs, renders the application of the concrete lining to the natural rock wall more difficult, or even impossible. Most of the conventional methods of applying the concrete lining to the natural rock bounding the underground space are based on the assumption that the natural rock bounding the excavation is relatively dry and stable, inasmuch as the presence of water streams, or even small dislocations of the natural rock which may be caused by water-pressure build-up, would result in destruction of the concrete applied to the natural rock to forming a lining thereon prior to the hardening of the concrete, which would result in destruction of the final lining even before it is hardened.

In some circumstances, the quantity of water which enters the underground space may be substantial, and such situations will be further referred to as underground springs; in other circumstances, the quantity of the water is negligible, but the pressure thereof caused by the column of water between the water table above the excavation and the latter may be substantial. It will be appreciated that the substantial amount of water flowing from the underground spring will entrain and carry away with it the freshly applied concrete from the vicinity of the spring; on the other hand, the pressure of the water, no matter how neglibible its amount is, behind the freshly applied concrete will cause its dissociation from the natural rock wall and, over a period of time, damage to the concrete lining. These problems have already been recognized, and it has already been proposed to provide a plurality or a network of draining channels between the concrete layer and the natural rock so as to remove the accumulating water from between the same.

Of several methods of removing seepage water from between the natural rock and concrete lining, two which are most closely related to the present invention will now be discussed. In the first method, spray concrete or gunite, to which a setting accelerator is added, is gunned on the wall of the tunnel or excavation until its thickness is sufficient to prevent the water seeping through the natural rock from entering the tunnel. However, this method has a serious drawback; namely, even if the concrete sets or hardens so quickly that it cannot be carried away by the water seeping into the tunnel, the pressure build-up behind the layer of the hardened spray concrete or gunite can cause entire plates to separate from the remainder of the concrete layer and fall into the underground space, whereupon the water again flows into the underground space and the final layer of concrete cannot be applied over the gunite layer. On the other hand, even if the gunite layer is strong enough to withstand the pressure of the seepage water until the final concrete layer is applied over the gunite layer and hardens to form the lining of the underground space, the water which accumulates between the natural rock wall and the gunite layer, which water is at relatively high pressure, flows even through finest hair cracks in the gunite and concrete layers into the interior of the tunnel. On the other hand, this method is rather advantageous in that it can be easily performed; all that is necessary for performing this method is a spraying arrangement for applying a jet of gunite to the natural rock wall. Another advantage of this method is that it is not necessary to cover the entire tunnel wall of natural rock with the gunite, but rather only the region of the wall surrounding and including the place at which the water infiltrates or seeps into the tunnel. Thus, this method is rather advantageous and inexpensive in terms of labor and material, and can be used under all circumstances where the amount or pressure of the seeping water are rather low.

In a second conventional method, rigid elongated shells of asbestos cement or flexible synthetic plastic material, having annular segment cross sections, are placed over the natural rock tunnel wall in the region of water seepage, and are manually connected to the tunnel wall by means of a concrete with a setting accelerator admixed thereto. Where a plurality of such shells is so connected to the natural rock wall of the underground space, a draining conduit system is obtained which is capable of conducting the seeping water away from the point of seepage and to a discharging location. The above draining system, which is provisionally attached to the natural rock wall by means of the quick-setting concrete, is then additionally covered by a layer of spray concrete or gunite, such a layer having a sufficient thickness to prevent seepage of water therethrough and to securely attach the shells to the natural rock wall. It will be appreciated that, as a result of the provision of the draining system in the region of water seepage, the build-up of high water pressures behind the layer of the spray concrete, due to the seepage of water through the natural rock surrounding the excavation, is avoided. However, this method also possesses a very serious drawback, which is the necessity of placing and attaching the draining shells manually, which is an extremely laborious and expensive proposition.

SUMMARY OF THE INVENTION

It is a general object of the present invention to avoid the disadvantages of the prior art methods.

More particularly, it is an object of the present invention to present a method of producing draining channels at a support surface from which seepage water is to be removed.

Even more particularly, it is an object of the present invention to present a method of providing a draining channel at a natural rock wall bounding an underground excavation, prior to application of a final lining of concrete thereto.

It is still another object of the present invention to provide a draining system at the natural rock wall bounding an underground excavation, which conducts the seepage water away from the point of entry into the underground excavation and to a discharge location so as to prevent damage to the lining during and after its formation and setting.

It is a concomitant object of the present invention to propose an apparatus particularly suited for performing the method of producing a draining channel according to the present invention.

In pursuance of these objects and others which will become apparent hereafter, one feature of the present invention resides in a method of producing a draining channel at the natural rock wall of an underground excavation, which includes the steps of applying snow to the natural rock wall in form of a strip or rope the length and crosssection of which correspond to the length and the crosssection of the draining channel to be formed between the natural rock wall and the lining; covering the snow strip and the regions laterally surrounding the snow strip with a quick-setting gunite, the covering layer having a sufficient thickness; and melting the snow strip either by heat accepted from the environment or by applying heat to the covering layer.

In a particularly advantageous application of the method for sealing and draining an underground hollow space, the present invention proposes the application of a plurality of strips of snow which extend parallel to one another and spaced from each other in the longitudinal direction of the longitudinal axis of the hollow space and in the region where the seepage water or spring water enters the underground space, each of the strips extending across the ceiling and from there along the natural rock walls in the downward direction, the strips and the laterally surrounding regions of the natural walls being subsequently melted either by the influence of the heat accepted from the environment, or by applying heat to the covering layer of gunite.

An apparatus according to the present invention which is particularly suited for performing the above-mentioned method includes a continuously operating icemaking machine, the ice produced in the machine emerging therefrom in the form of granules which are then comminuted in a mechanical comminuting device located downstream of the ice-making machine, the snow produced in the comminuting device entering a conduit in which it is entrained by a stream of pressurized air which carries the snow to a snow-spraying nozzle.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 2 is a cross-sectional view of the tunnel of FIG. 1 but with a full lining provided therein;

FIG. 3 is a partial longitudinally sectional view taken on line III—III of FIG. 2.

DETAILED DESCRIPTION OF THE PREFERRED EMBODIMENTS

Figure 1:
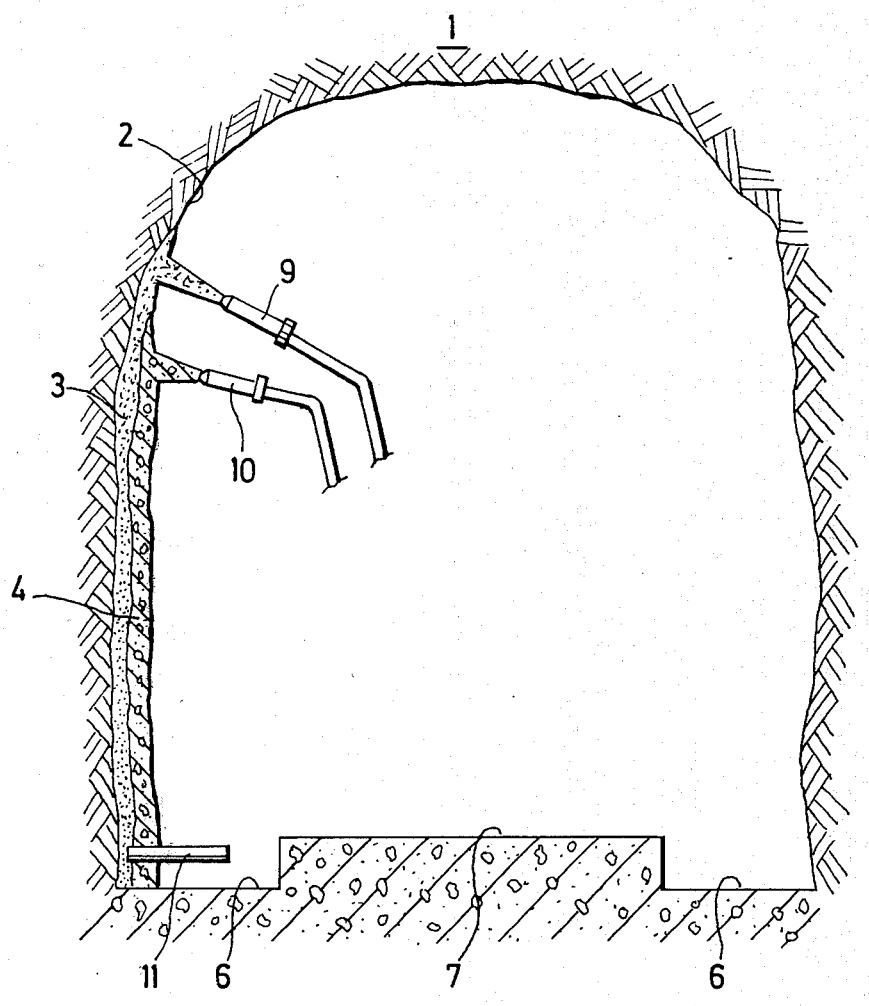
FIG. 1 is a cross-sectional view of a tunnel with a partially produced draining channel.
Figure 4:
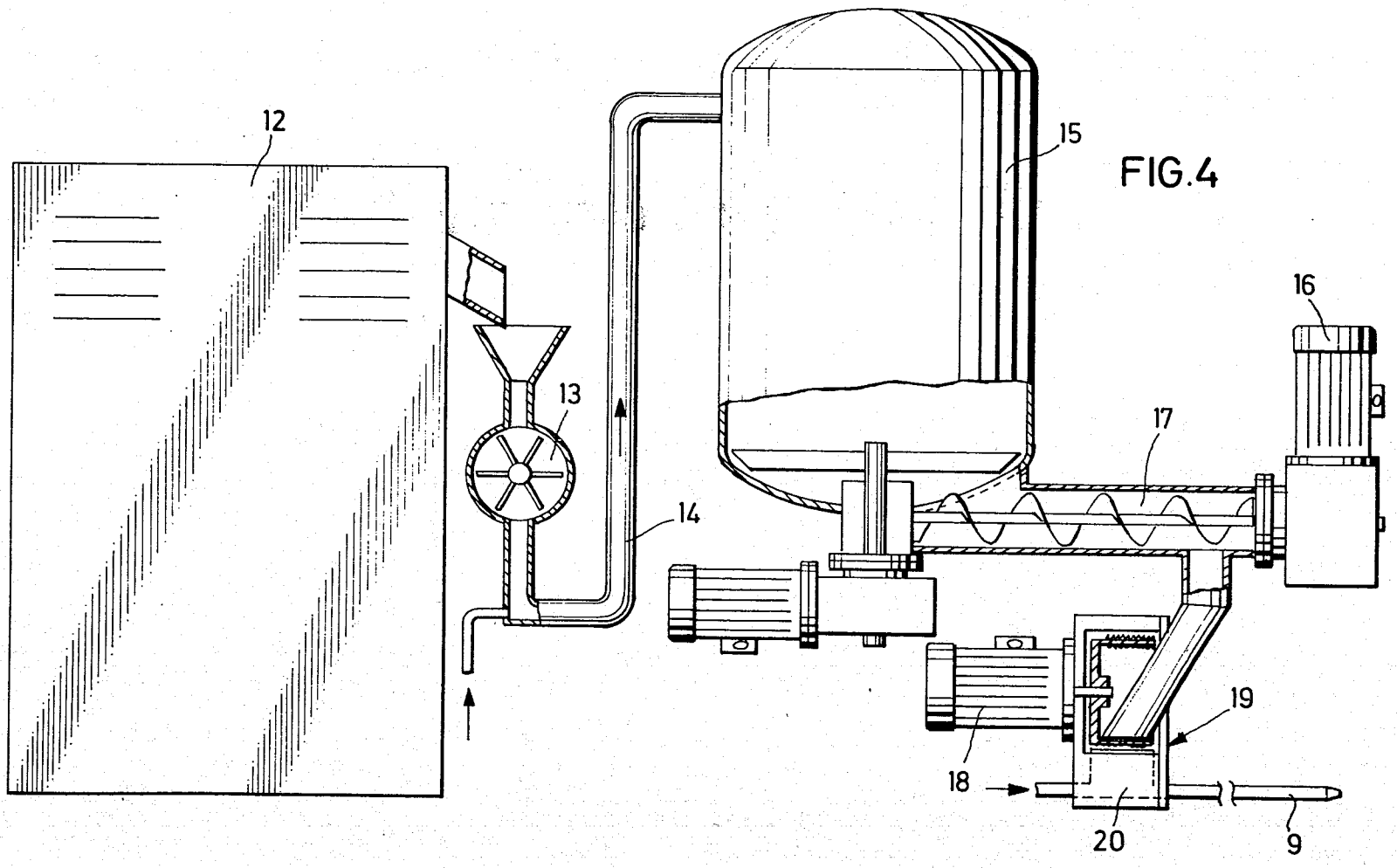
FIG. 4 is a diagrammatic side view of an example of a machine for performing a method for producing draining channels.

Referring now to the drawing in more detail, and first to FIGS. 1 and 2 thereof, it may be seen that these Figures illustrate a cross-sectional view of a tunnel. The reference numeral 1 designates the rock which surrounds the tunnel and the reference numeral 2 relates to a natural rock wall which bounds the tunnel. An elevated track 7 is provided in the lower region of the tunnel and two ditches or drains 6 extend along the track 7 and serve the purpose of conducting water present in the tunnel to a distant location at which the water is removed from the tunnel. Water seeps through the tunnel wall 2 into the tunnel or a similar underground space, and this water must be conducted into the ditch or drain 6 to flow therethrough out of the tunnel. For this purpose, there are provided caterpillar-shaped strips 3 of snow in the region of seepage of water into the tunnel, the strips being arranged in spaced relationship with respect to one another in the longitudinal direction of the tunnel by a distance of preferably 300 millimeters, the strips 3 being applied to the natural wall 2 preferably by using a snow nozzle or jet 9. Each of the snow strips 3 is preferably 100 millimeters wide and 30 millimeters high. Of course, the spacing and other dimensions of the snow strips 3 will depend on the particular conditions at any given location, such as the quantity of water seeping into the tunnel, the location of the points of entry and similar considerations. The strips 3 are made of snow, which expression is intended to indicate any harmless substance in particulate form which is capable of adhering to the wall of the underground excavation in form of the strip, retaining its shape for a limited period of time, and then melting and flowing away to leave behind it the draining channel. Experience has shown that artificially produced water snow is one of the substances which have the above-discussed properties, is rather inexpensive to produce, and easy to obtain.

As illustrated in FIG. 1, the formation of the snow strip 3 may be begun at the lower end of the tunnel wall 2 at the ditch or drain 6, the jet or nozzle 9 then applying the snow to the tunnel wall 2 from below to above. Immediately after the snow strip 3 has obtained its desired dimensions, it and the surrounding regions of the tunnel wall 2 are covered with a layer of spray concrete or gunite 4 by means of an additional spray nozzle 10. A setting accelerator is added to the spray concrete so as to enhance the setting or hardening thereof so that the covering layer 4 which covers the tunnel wall 2 and the strip 3 applied thereto in a sufficient thickness, hardens before the snow strip 3 melts away. Potassium silicate can be used as a setting accelerator; further suitable setting accelerators are marketed under the trade names Barra and Sigunite. Prior to covering the snow strip 3 with the spray concrete or gunite, a discharge tube 11 is arranged at the lower part of the strip 3, such as by inserting the tube 11 into the strip 3. The tube 11 communicates the region of the strip 3 with the region of the drain or ditch 6 even after the layer 4 of spray concrete or gunite is applied on the strip 3 and the surrounding region of the natural rock wall 2. Thus, when heat from the rock 1, on the one hand, and the spray concrete or gunite 4, on the other hand, both of which are at temperatures above the melting point of the snow strip 3, cause the latter to melt, the fluid medium which has previously formed the snow strip 3 escapes from behind the layer 4, leaving behind a channel through which the seepage water can flow into the tube 11 and through the same into the ditch or drain 6.

The snow strips 3 can be arranged parallel to one another, or form a network at the tunnel 2, always taking into consideration the requirements given by the configuration of the wall 2 and the multitude and distribution of the seepage points at any particular location.

As illustrated in FIG. 3, a sufficiently thick layer of spray concrete or gunite is applied to the tunnel wall 2 between the snow strips 3 covered with a layer of spray concrete or gunite, or between the draining channels 3 formed at the tunnel wall 2 after melting of the snow strip 3 so that a continuous homogeneous sealing layer ensues. The seepage water which flows from the rock 1 in direction toward the tunnel is diverted by this homogeneous layer into one of the draining channels which have been formed by utilizing the snow strips 3, and then flows through the tube 11 into the ditch or drain 6. Subsequently thereto, such as when the layer 4 is fully hardened, a concrete lining 5 can be arranged adjacent to the sealing layer 4, which gives the tunnel its final appearance and also prevents the cave-in of the natural rock into the tunnel.

A commerically available ice-making machine 12, for instance available under the trade name Scotsman, is used for producing the snow. The ice-making machine 12 delivers ice in form of ice cubes, crushed ice or flakes. The ice falls through an air lock 13 in a blowing conduit 14 through which it is propelled by an airstream into a supply container 15. The ice in the container 15 is delivered in metered quantities to a milling cutter 19 driven by a motor 18, by means of a transport screw 17 driven by a motor 16. Snow to which the ice is comminuted in the milling cutter 19 falls into a pressurized air conduit 20, is entrained into the pressurized air flowing through the conduit 20 and delivered to the jet or nozzle 9 through which it exits at a high speed and is applied to the tunnel wall 2. The hardness of the snow strip 3 will depend on the exit speed of the snow from the nozzle 9; the higher the speed the harder the snow in the snow 3, and vice versa. The beam of snow which exits from the nozzle 9 has a low degree of spreading, which renders possible the accurate application of the snow strip 3. With this equipment, approximately 2 meters length of the strip 3 is applied to the wall 2 every minute. As a rule, the spray concrete or sealing gunite 4 is to be applied within the next minute, particularly since the snow strip 3 has sufficient adherence to the tunnel wall only during this time period. The spraying of the spray concrete or gunite can be accomplished with spraying machines which are readily available, so that any description thereof can be dispensed with without impairing the understanding of the present invention.

The melting process sets in rather rapidly in the snow strip 3, which assures the secure draining and conducting away of the seepage water. If the underground spring delivers large quantities of water, instead of forming the snow strip 3 in its entirety as discussed above, the strip is applied to the tunnel wall 2 only to a location just underneath the point of entry of the seepage water into the tunnel, then the layer of gunite 4 is applied to the strip 3 and the surrounding area of the wall 2 while the spring proper is still open into the interior of the tunnel, and the spring is covered with the snow strip 3 and the layer of gunite 4 only after the draining channel has been formed in the previously applied layer 4 so that the spring water flows therethrough into the ditch 6. Depending on the desired snow temperature, the pressurized air which transports the snow to the nozzle 9 can be cooled to a greater or lesser degree. In the event that the heat supplied to the rope 3 from the surrounding rock and/or the gunite layer 4 should be insufficient to assure the desired speed of melting of the snow strip 3, additional heat produced by conventional heaters can be applied to the layer 4 so as to melt the snow strip 3 more rapidly.

It will be understood that each of the elements described above, or two or more together, may also find a useful application in other types of constructions differing from the type described above.

While the invention has been illustrated and described as embodied in a method and an apparatus for producing a draining channel at a surface, particularly at a surface bounding a tunnel, it is not intended to be limited to the details shown since various modifications and structural changes may be made without departing in any way from the spirit of the present invention.

Without further analysis, the foregoing will so fully reveal the gist of the present invention that others can be applying current knowledge readily adapt it for various applications without omitting features that, from the standpoint of prior art, fairly constitute essential characteristics of the generic and specific aspects of this invention.

What is claimed as new and desired to be protected by Letters Patent is set forth in the appended claims:

1. A method of producing a draining channel at a surface, comprising the steps of applying a strip of temporarily solid flowable substance to the surface, the dimensions of the strip corresponding to the dimensions of the draining channel to be produced; covering the strip and the adjacent regions of the surface with a layer of quick-setting concrete; and allowing the solid substance to assume its flowable state and conducting the flowable substance away from between the surface and the layer so that a draining channel is formed at the surface.

2. A method as defined in claim 1, wherein said temporarily solid substance is snow; and wherein said allowing step includes melting the snow.

3. A method as defined in claim 1, wherein said covering step includes spraying the quick-setting concrete on the strip and on the adjacent regions of the surface.

4. A method as defined in claim 1, wherein said allowing step includes application of heat to the strip.

5. A method as defined in claim 1, wherein said applying step includes providing at least one snow strip at a natural rock surface bounding an underground space in the region thereof where water seeps into the underground space so as to drain the seepage water from said region.

6. A method as defined in claim 5, wherein said at least one snow strip extends transversely of the ceiling of the underground space and subsequently downwardly therefrom at the lateral walls of the underground space.

7. A method as defined in claim 1, wherein said applying step includes spraying the temporarily solid substance on the surface.

8. A method as defined in claim 1, wherein said applying step includes continuously spraying snow under pressure on the surface; and wherein said covering step includes spraying the quick-setting concrete layer on the snow strip and on the adjacent regions of the surface immediately following said applying step.

9. A method as defined in claim 8, wherein said covering step is performed at one location of the surface to which the snow strip has been already applied, simultaneously with applying the same snow strip to a different location of the surface.

10. A method as defined in claim 2 wherein said applying step includes mechanically comminuting ice particles to form the snow, and entraining the snow into a stream of cool air leading to a spraying nozzle.

11. A method as defined in claim 10, said applying step further including forming the ice particles to be comminuted to form the snow.

12. A method as defined in claim 1, wherein said applying step includes forming a snow strip on the surface, the snow strip being 50 to 150 millimeters wide and 15 to 45 millimeters high.

13. A method as defined in claim 12, wherein the strip is 100 millimeters wide and 30 millimeters high.

14. A method as defined in claim 1, wherein said applying, covering and allowing steps are repeated over a seepage region of the surface to form an array of draining channels thereon.

* * * * *